US005928989A

United States Patent [19]

Ohnishi et al.

[11] Patent Number: 5,928,989

[45] Date of Patent: Jul. 27, 1999

[54] THERMAL TRANSFER FILM FOR PROTECTIVE LAYER AND PRINT

[75] Inventors: Jiro Ohnishi; Katsuyuki Oshima; Mikiko Kudo; Atsushi Tatehana, all of Tokyo-To, Japan

[73] Assignee: Dai Nippon Printing Co., Ltd., Japan

[21] Appl. No.: 08/776,315

[22] PCT Filed: May 29, 1996

[86] PCT No.: PCT/JP96/01448

§ 371 Date: Jan. 30, 1997

§ 102(e) Date: Jan. 30, 1997

[87] PCT Pub. No.: WO96/38308

PCT Pub. Date: May 5, 1996

[30] Foreign Application Priority Data

Jun. 1, 1995 [JP] Japan ..... 7-158531

[51] Int. Cl.[6] ..... B41M 5/035; B41M 5/38

[52] U.S. Cl. ..... 503/227; 428/195; 428/206; 428/304.4; 428/913; 428/914

[58] Field of Search ..... 8/471; 428/195, 428/323, 447, 913, 914, 206, 304.4; 503/227

[56] References Cited

U.S. PATENT DOCUMENTS

| | | | |
|---|---|---|---|
| 4,756,963 | 7/1988 | Yamamoto et al. | 428/334 |
| 4,780,348 | 10/1988 | Yamamoto et al. | 428/43 |
| 5,387,573 | 2/1995 | Oldfield et al. | 503/227 |

FOREIGN PATENT DOCUMENTS

| | | | |
|---|---|---|---|
| 178 322 A1 | 4/1986 | European Pat. Off. | 503/227 |
| 59127798 | 7/1984 | Japan | 428/488.4 |
| 60083874 | 5/1985 | Japan | 503/227 |
| 61164863 | 7/1986 | Japan | 347/105 |
| 01127379 | 5/1989 | Japan | 503/227 |

*Primary Examiner*—Bruce H. Hess
*Attorney, Agent, or Firm*—Parkhurst & Wendel, L.L.P

[57] ABSTRACT

In order to enable stamping or writing with an aqueous ink on a print with a colorant image or the like formed thereon and, at the same time, to impart fastness properties, such as weather resistance, chemical resistance, and solvent resistance to the print, there are provided a thermal transfer film for a protective layer, which, upon transfer on a print, can form a protective layer having a water-absorptive property and the above fastness, and a print with a protective layer transferred from the above transfer film.

The thermal transfer film for a protective layer basically comprises a heat-resistant substrate film and a thermally transferable protective layer laminated thereto. The thermally transferable protective layer is thermally separated from the substrate and laminated on a print with a colorant image.

10 Claims, 1 Drawing Sheet

THERMAL TRANSFER FILM FOR PROTECTIVE LAYER AND PRINT

FIELD OF UTILIZATION IN INDUSTRY

The present invention relates to a thermal transfer film, for a protective layer, with a protective layer separably provided thereon, and more particularly to a thermal transfer film, for a protective layer, which can impart stampability and writability with a pen using an aqueous ink, a fountain pen, or the like and, at the same time, fastness, such as excellent weather resistance, chemical resistance, and solvent resistance, to an image formed by a thermal transfer recording system.

BACKGROUND OF INVENTION

Various thermal transfer methods are known in the art, and one of them is a sublimation type thermal recording system in which, using a thermal transfer sheet comprising a substrate film bearing a dye layer containing a heat sublimable dye and a binder, the dye contained in the dye layer is sublimated (thermally transferred) in response to image information by heating means, such as a thermal head or a laser beam, to conduct recording. Further, a hot-melt type thermal recording system is also known in which, using a thermal transfer sheet comprising a substrate film bearing a hot-melt ink layer containing a colorant, such as a pigment, and a vehicle, such as wax, a hot-melt ink component softened by the same heating means as used in the sublimation type thermal recording system is transferred to form an image. These thermal transfer methods permit various images to be simply formed and, hence, have become utilized in prints wherein the number thereof may be small, for example, in the preparation of identification (ID) cards and various certificates.

For the preparation of the ID card or the like using the above thermal transfer sheet, the use of the hot-melt type thermal transfer sheet can easily provide monotonous images, such as letters and numerals. These images, however, are disadvantageously poor in fastness, particularly abrasion resistance. On the other hand, the use of the sublimation type thermal transfer sheet enables a gradational image, such as a photograph-like image of a face, to be precisely formed. Unlike usual images formed using a printing ink, however, the image formed by the sublimation type thermal transfer sheet is free from any vehicle and is unsatisfactory in fastness, such as weather resistance, abrasion resistance, and chemical resistance, although the image is a dye image.

Lamination of a thermal transfer film, for a protective layer, having a thermally transferable resin layer onto an image formed by the thermal transfer of a hot-melt colorant layer or a heat sublimable dye followed by the transfer of the thermally transferable resin layer by means of a thermal head or a heating roll to form a protective layer on the image is known as means for solving the above problem.

The provision of the protective layer can improve the abrasion resistance, chemical resistance, solvent resistance and other properties of the image to some extent, and the incorporation of an ultraviolet absorber or the like to the protective layer results in improved light fastness. Since, however, the protective layer has no water absorption capacity, an image with the above protective layer cannot be used in applications where stamping in an aqueous ink is necessary, for example, for a photographic image of a face in a passport. Therefore, this unfavorably imposes a limitation on the type of writing materials and stamps usable in writing of letters or affix of stamps.

Further, there is a demand for higher chemical resistance and solvent resistance of a photographic image of a face for a passport or the like from the viewpoint of preventing forgery of the passport or the like. Conventional protective layers, even those formed of a cured or crosslinked resin, however, offer no satisfactory fastness. Accordingly, an object of the present invention is to solve the problems of the prior art and to provide a thermal transfer film, for a protective layer, which, upon transfer on a print, can form a protective layer, for an image, having a capability of absorbing and fixing an aqueous ink and, hence, possessing excellent stampability and writability and, at the same time, possessing better chemical resistance and solvent resistance, and to provide a print with the above protective layer formed thereon.

DISCLOSURE OF INVENTION

In order to solve the above problems, the present inventors have developed a thermal transfer film, for a protective layer, comprising a heat-resistant substrate film and at least one thermally transferable protective layer provided on the substrate film, which, upon transfer of the thermally transferable protective layer on a print, forms a protective layer, for an image, possessing a water absorption property and, at the same time, excellent chemical resistance and solvent resistance.

Specifically, in the thermal transfer film for a protective layer according to a preferred embodiment of the present invention, the thermally transferable protective layer comprises a water-absorptive surface layer which, upon transfer of the thermally transferable protective layer, constitutes the outermost surface and comprises a substantially transparent porous layer, or the water-absorptive surface layer adapted to form the outermost surface after transfer of the thermally transferable protective layer comprises at least a partially water-absorptive layer comprising a water-absorptive fine area and a water-resistant fine area. Preferably, the water-absorptive fine area comprises a resin comprising at least both a water-soluble resin and a water-insoluble resin.

Further, according to a preferred embodiment of the present invention, the substantially transparent porous layer or the water-resistant fine area is formed of a material composed mainly of fine particles having an average particle diameter of not more than 0.1 $\mu$m. Further, preferably, the material constituting the substantially transparent porous layer or the water-resistant fine area comprises a water-resistant resin binder.

Furthermore, according to a preferred embodiment of the present invention, the thermally transferable protective layer contains an ultraviolet absorbing material. Preferably, the thermally transferable protective layer and at least one of a thermally sublimable colorant layer and a hot-melt colorant layer are provided in a face serial manner on a substrate film.

Thus, lamination of the thermally transferable protective layer on the surface of a print with a colorant image can offer a print that permits a stamp of an aqueous ink to be affixed thereto and, at the same time, possesses chemical resistance and solvent resistance.

The protective layer formed, on an image, by using the thermal transfer film for a protective layer according to the present invention comprises a water-absorptive layer, making it possible to affix a stamp of an aqueous ink or write with a pen using an aqueous ink on a print that does not inherently permit an aqueous ink to be fixed thereon.

BEST MODE FOR CARRYING OUT THE INVENTION

Figure 1:
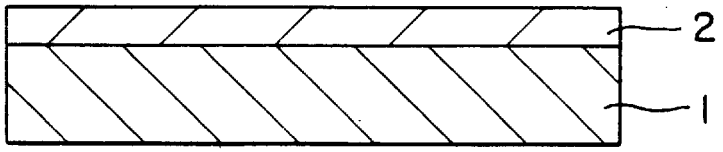
FIGS. 1, 2, 3 and 4 are cross-sectional views illustrating embodiments of the thermal transfer film for a protective layer according to the present invention.

The present invention will be described in more detail with reference to the following preferred embodiments. FIGS. 1, 2, 3 and 4 are schematic cross-sectional views illustrating embodiments of thermal transfer film for a protective layer according to the present invention. FIG. 1 is an embodiment, of the thermal transfer film for a protective layer, having the simplest layer construction. This thermal transfer film comprises a substrate film and a thermal transferable protective layer, provided on one side of the substrate film, which has a single layer structure and is constituted by a water-absorptive surface layer as the outermost surface layer.

Figure 2:
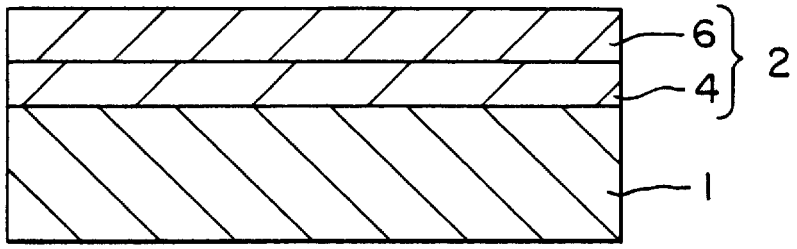

The thermal transfer film, for a protective layer, shown in FIG. 2 comprises a substrate film 1 and, provided on one side of the substrate film 1, a thermally transferable protective layer 2 having a two-layer structure of a water-absorptive surface layer 4 and a heat-sensitive resin layer 6 laminated in that order from the substrate film side. The thermal transfer film, for a protective layer, shown in FIG. 3 comprises a substrate film 1 and, provided on one side of the substrate film 1, a thermally transferable protective layer 2 having a three-layer structure of a water-absorptive surface layer 4, ultraviolet barrier layer 5, and a heat-sensitive resin layer 6 laminated in that order from the substrate film side. The thermal transfer film, for a protective layer, shown in FIG. 4 comprises a substrate film 1; and, provided on one side of the substrate film in the following order, a release layer 3 and a thermally transferable protective layer 2 having a three-layer structure of a water-absorptive surface layer 4, an ultraviolet barrier layer 5, and a heat-sensitive resin layer 6 laminated in that order on the release layer; and a backside layer 7, provided on the other side of the substrate film, for imparting heat resistance and a slip property to the thermal transfer film.

Figure 3:
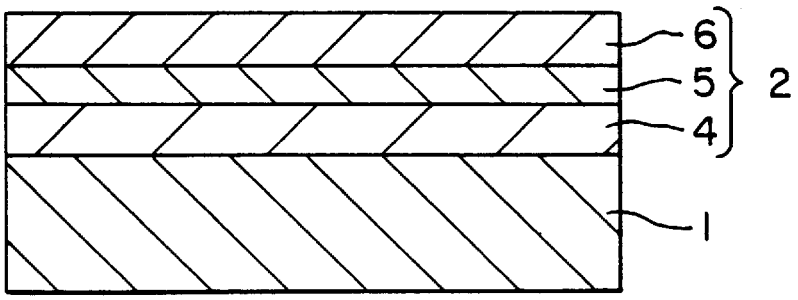

The backside layer 7 functions to prevent the thermal transfer film from being heat-fused to a thermal head of a printer and may be, if necessary, provided also in the thermal transfer films shown in FIGS. 1 to 3 although the backside layer is not shown in these drawings. The provision of the backside layer is unnecessary when the substrate film has good heat resistance and slip property. If the separation between the substrate film and the thermally transferable protective layer is unsatisfactory, a release layer 3 may be provided between the substrate film and the thermally transferable protective layer. The release layer functions to modify the adhesion between the thermally transferable protective layer and the substrate film so that the thermally transferable protective layer can be satisfactorily separated from the substrate film. Although this layer also is not shown in FIGS. 1 to 3, it may be, if necessary, provided in the thermal transfer films shown in FIGS. 1 to 3.

It is a matter of course that when the separation between the substrate film and the thermally transferable protective layer is satisfactory, the provision of the release layer 3 is basically unnecessary. The release layer 3 is provided so that, upon thermal transfer, the thermally transferable protective layer 2 is separated from the release layer 3 with the release layer 3 per se remaining on the substrate film.

Materials and production processes for the thermal transfer film for a protective layer according to the present invention and the print formed by using this thermal transfer film according to the present invention will be described.

At the outset, the substrate film and each layer constituting the thermal transfer film for a protective layer according to the present invention will be described.

Substrate Film

The substrate film for the thermal transfer film for a protective layer according to the present invention is not particularly limited. Specifically, substrate films used in the conventional thermal transfer films as such may be used, and, in addition, films having a surface which has been treated for improving the adhesion, and other films may also be used.

Specific examples of preferred substrate films include plastic films of polyesters, including polyethylene terephthalate, polycarbonates, polyamides, polyimides, cellulose acetate, polyvinylidene chloride, polyvinyl chloride, polystyrene, fluororesins, polypropylene, polyethylene, ionomers and the like; papers such as glassine paper, capacitor paper, and paraffin paper; cellophane; and the like. Further, composite films comprising laminates of two or more of the above films may also be used. The thickness of the substrate film may be varied depending upon the material so as to give proper strength and heat resistance. In general, however, it is preferably about 3 to 100 $\mu$m.

Release Layer

Figure 4:
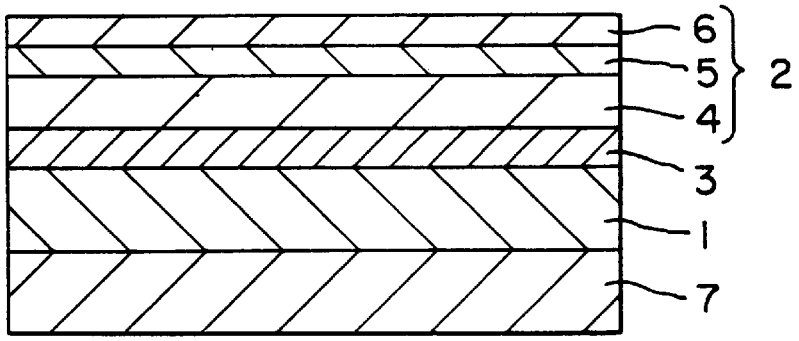

In general, a thermally transferable protective layer 2 is provided on one side of the substrate film to form a transfer film. For some combination of materials for the substrate film and the thermally transferable protective layer 2, the separation between the substrate film and the thermally transferable protective layer 2 is unsatisfactory at the time of thermal transfer. In such a case, a release layer 3 may be previously provided on the surface of the substrate film (FIG. 4). The release layer 3 may be formed by coating a coating liquid, containing at least one member selected from waxes, silicone wax, silicone resin, fluororesins, acrylic resin, polyvinyl alcohol resin, cellulose derivative resins, urethane resin, vinyl acetate resin, acrylic vinyl ether resin, maleic anhydride resin, and copolymers of these resins, by a conventional coating method, such as gravure coating or gravure reverse coating. A coating thickness of about 0.1 to 2 $\mu$m suffices for the release layer.

According to the present invention, the release layer 3 may have fine irregularities on its surface. The fine irregularities can increase the surface area of the water-absorptive surface layer, improving the water absorption capacity. In the selection of the material for the release layer 3, the material selected should, of course, have suitable releasability from the thermally transferable protective layer 2. In addition, importantly, the adhesion to the substrate film should be higher than that to the thermally transferable protective layer 2. Unsatisfactory adhesion to the substrate film is causative of abnormal transfer, such as transfer of the release layer together with the protective layer. This is the reason why the above material is used.

Thermally Transferable Protective Layer

In the thermal transfer film for a protective layer according to the present invention, the thermally transferable protective layer 2 is thermally transferred on a print face in an object to form a protective layer. Therefore, functions which the thermally transferable protective layer 2 should have include: sure separation (good transferability) from the substrate film or the release layer 3 provided thereon at the time of thermal transfer, and good adhesion to an object. Further, the protective layer formed by the transfer of the thermally transferable protective layer should have properties to assure that the protective layer should be able to absorb an aqueous ink, a stamp of an aqueous ink can be affixed thereon, writing with a non-oil-based material is possible, it can impart various fastness, such as abrasion resistance, scratch resistance and, in addition, good chemical resistance and solvent resistance, it has transparency high enough to faithfully reproduce the image on the transferred face, and it can prevent the image from deteriorating with the elapse of time due to ultraviolet irradiation or the like, that is, it can improve the weather resistance of the image. As described above, as shown in FIG. 1, the thermally transferable protective layer 2 may have a single layer structure. If necessary, however, as shown in FIGS. 2 to 4, the thermally transferable protective layer has a multi-layer structure of two or three layers, that is, may comprise a water-absorptive surface layer 4 and a heat-sensitive resin layer 6 in that order from the substrate film side, or alternatively a water-absorptive surface layer 4, an ultraviolet barrier layer 5, and a heat-sensitive resin layer 6 in that order from the substrate film side. Each layer constituting the thermally transferable protective layer will be described.

Water-Absorptive Surface Layer

The water-absorptive surface layer 4 provided on the substrate film or the release layer 3 is not particularly limited so far as it has water absorption properties. Preferably, it further possesses additional properties including water resistance, solvent resistance, such as alcohol resistance and acetone resistance, and plasticizer resistance. One method for forming the water-absorptive surface layer 4 having water absorption properties is to form the water-absorptive surface layer 4 as a substantially transparent porous layer.

Transparent Porous Layer

Methods which are considered usable for forming the water-absorptive surface layer 4 as a transparent porous layer include, for example, a method which comprises the steps of: dissolving a certain resin in a solvent mixture of a low-boiling solvent, which is a good solvent for the resin, with a high-boiling solvent, which is a poor solvent for the resin, to prepare a resin-containing ink; coating the resin-containing ink on the substrate film or the release layer 3; drying the coating to first remove the low-boiling good solvent and then removing the high-boiling poor solvent, and a method wherein lyophilization is utilized. Both the above methods, however, are unsatisfactory because it is difficult to form a water-absorptive surface layer having satisfactory transparency and physical strength of the porous layer.

One simple method for forming a porous layer having high transparency and physical strength is to disperse fine particles in water or an organic solvent followed by drying the coating. When the formed film is homogeneous with the bonding strength among the fine particles being satisfactory, the use of any binder for binding the fine particles to one another is not required. On the other hand, the addition of a binder and a material serving as a dispersion stability or a thickener is necessary in the case of unsatisfactory bonding strength among the fine particles or in the case where, in the coating of the fine particles followed by drying of the coating, the particles are agglomerated rendering the result film heterogeneous.

There is no particular limitation on the shape of the fine particles, and the fine particles may be in any form, for example, spherical, acicular, or undefined form. When spherical particles are used, they preferably have as homogeneous as possible diameters. Formation of a porous layer using fine particles having heterogeneous diameters results in lowered porosity as compared with the porous layer formed using homogeneous fine particles, thus deteriorating the water absorption capacity.

The particle diameter of the fine particles is not particularly limited so far as the formed porous layer is substantially transparent. However, when the porous layer is formed using, for example, spherical fine particles, the average particle diameter is preferably not more than 0.3 μm, particularly preferably not more than 0.1 μm, from the viewpoint of ensuring substantial transparency. When the average particle diameter is more than 0.3 μm, it is difficult to ensure the transparency.

The thickness of the transparent porous layer as the water-absorptive surface layer is preferably 0.1 to 200 μm, particularly preferably 1.0 to 50 μm. When the thickness is less than 0.1 μm, the water absorption capacity and the fastness are unsatisfactory, while a thickness exceeding 200 μm poses a problem associated with the transparency and the transferability.

The fine particles may be made of either an organic material or an inorganic material. Organic fine particles usable herein include, for example, acrylic fine particles, cellulosic fine particles, and non-cellulosic polysaccharide fine particles. Inorganic fine particles usable herein include, for example, fine particles of silica or its modified products, alumina sol, and fine particles of other metals and metal oxides. Particularly preferably, the fine particles have high solvent resistance and a hydrophilic group on the surface thereof. The most preferred fine particles satisfying these property requirements are colloidal silica with Snowtex series manufactured by Nissan Chemical Industry Ltd. and Cataloid series manufactured by Catalysts and Chemicals Industries Co., Ltd. being favorable.

The binder for strongly binding individual particles to one another is not particularly limited, and any material may be used as the binder so far as it has satisfactory properties as the binder. However, when the colloidal silica is used as the fine particles, the use of a water-soluble resin as the binder is particularly preferred. Specific examples of water-soluble resins usable herein include polyvinyl alcohol, PVA resins, water-soluble polyester resins, alkyl vinyl ether resin, maleic acid copolymer resin, polyvinyl pyrrolidone resins, cellulosic resins, water-soluble alkyd resins, and noncellulosic water-soluble polysaccharides.

Among them, PVA resins are a particularly preferred binder. The mixing ratio of the colloidal silica to the PVA resin is preferably $1/30 \leqq$ PVA resin/colloidal silica $\leqq 1/3$ (weight ratio). When the weight ratio is less than 1/30, the effect of the PVA resin as the binder is unsatisfactory. On the other hand, when it exceeds 1/3, it is impossible to form a porous structure, losing the water absorption properties. Curing of the binder with a curing agent or the like results in further improved water resistance and solvent resistance of the porous layer. When the PVA resin is used as the binder, useful curing agents include, for example, Sumirez Resin series typified by Sumirez Resin 5004 manufactured by Sumitomo Chemical Co., Ltd.

Imparting Water Resistance by Partially Water-Absorptive Layer

Partially imparting water resistance to the water-absorptive surface layer 4 is considered as means for imparting water absorption properties and, at the same time, water resistance. In order to achieve this, the water-absorptive surface layer 4 is constituted by a partially water-absorptive layer comprising at least a water-absorptive fine area having water absorption properties and a water-resistant fine area having water resistance. One possible method for forming the partially water-absorptive layer comprises mixing a water-absorptive resin with a water-resistant resin and regulating the compatibility between these resins to permit the water-absorptive resin and the water-resistant resin to form the so-called "islands-sea structure," thereby forming the partially water-absorptive layer comprising a water-absorptive fine area and a water-resistant fine area.

A method for forming the partially water-absorptive layer having better water absorption properties and water resistance is to fill a water-absorptive resin into the pores of the transparent porous layer. In this case, the water-absorptive resin constitutes the water-absorptive fine area, and the area constituting the transparent porous layer corresponds to the water-resistant fine area. Any method may be used for filling the water-absorptive resin into the pores of the transparent porous layer. One simple method, for example, is to coat an ink containing a water-absorptive resin on the surface of the transparent porous layer by roll coating or the like to impregnate the ink containing the water-absorptive resin into the pores of the transparent porous layer.

Any material may be used, without particular limitation, for forming the water-absorptive fine area so far as it has water absorption properties. However, most preferred are water-soluble materials, and specific examples of water-soluble materials for the water-absorptive fine area include seaweed extracts, such as agar and sodium alginate, plant viscous materials, such as gum arabic and hibiscus, animal proteins, such as casein and gelatin, fermentation viscous materials, such as pullulan and dextran, starch and starchy materials, cellulosic materials, such as methyl cellulose, carboxymethyl cellulose, and hydroxyethyl cellulose, synthetic polymers, such as polyvinyl pyrrolidone, alkyl vinyl ether, polymaleic acid copolymer, water-soluble polyesters, and polyvinyl alcohol, and inorganic polymers, such as sodium polyphosphate.

The water-absorptive fine area may be constituted by the above water-absorptive material alone. However, the water-absorptive fine area formed of a mixture of the water-absorptive material with the water-resistant material is preferred from the viewpoint of further improving the water resistance and the solvent resistance of the whole water-absorptive protective layer. Any material may be used as the water-resistant material, without particular limitation, so far as it has good compatibility with the water-absorptive material and can form a homogeneous film.

The above transparent protective layer 4 may be formed by coating a coating liquid containing the above resin by gravure coating, gravure reverse coating, roll coating, or various other means and drying the coating.

Ultraviolet Barrier Layer

According to the present invention, the provision of an ultraviolet barrier layer in the thermally transferable protective layer is preferred from the viewpoint of preventing an image formed in a print, on which the protective layer is to be transferred, from being faded or discolored by ultraviolet light contained in the sunlight or the like. The ultraviolet barrier layer is formed by coating an ink of a resin with an ultraviolet absorber added thereto to form a coating. Ultraviolet absorbers usable herein include conventional organic ultraviolet absorbers, such as benzophenone compounds, benzotriazole compounds, oxalic anilide compounds, cyanoacrylate compounds, and salicylate compounds. Further, it is also possible to add fine particles of inorganic materials having an ultraviolet absorption capability, such as oxides of zinc, titanium, cerium, tin, iron and the like, to the resin. Any resin may be used for this purpose without particular limitation, and examples of resins usable herein include hydrocarbon resins, such as acrylic resins, polyester resins, urethane resins, styrene resins, halogenated vinyl resins, vinyl acetate resins, polycarbonate resins, phenolic resins, melamine resins, epoxy resins, cellulosic resins, and polyethylene; vinyl resins, such as polyvinyl alcohol and polyvinyl pyrrolidone; and copolymers thereof. Furthermore, the ultraviolet absorber may be incorporated into the water-absorptive surface layer and the heat-sensitive resin layer instead of deliberate provision of the ultraviolet barrier layer.

Furthermore, a resin with a reactive ultraviolet absorber chemically bonded thereto may be incorporated alone or as a mixture into the water-absorptive surface layer 4 and/or the heat-sensitive adhesive resin layer 6, or alternatively, these resins may be provided as the ultraviolet barrier layer. The reactive ultraviolet absorber may be chemically immobilized onto the resin by various methods. For example, the conventional monomer, oligomer, or resin component of a reactive polymer may be radically polymerized with the reactive ultraviolet absorber having an addition polymerizable double bond to produce a copolymer. When the reactive ultraviolet absorber has a hydroxyl, amino, carboxyl, epoxy, isocyanate or other group, it is possible to use a method wherein a thermoplastic resin having a group reactive with the above functional group is used and the reactive ultraviolet absorber is chemically immobilized onto the thermoplastic resin by heat or the like optionally in the presence of a catalyst. Monomers copolymerizable with the reactive ultraviolet absorber include the following compounds:

methyl (meth)acrylate, ethyl (meth)acrylate, propyl (meth)acrylate, butyl (meth)acrylate, isobutyl (meth) acrylate, tert-butyl (meth)acrylate, isodecyl (meth) acrylate, lauryl (meth)acrylate, lauryl tridecyl (meth) acrylate, tridecyl (meth)acrylate, cerylstearyl (meth) acrylate, stearyl (meth)acrylate, ethylhexyl (meth) acrylate, octyl (meth)acrylate, cyclohexyl (meth) acrylate, benzyl (meth)acrylate, methacrylic acid, hydroxyethyl (meth)acrylate, hydroxypropyl (meth) acrylate, dimethylaminoethyl (meth)acrylate, diethylaminoethyl (meth)acrylate, tert-butylaminoethyl (meth)acrylate, glycidyl (meth)acrylate, tetrahydrofurfuryl (meth)acrylate, ethylene (meth)acrylate, diethylene glycol (meth)acrylate, triethylene glycol di(meth) acrylate, tetraethylene glycol di(meth)acrylate, decaethylene glycol (meth)acrylate, pentadecaethylene (meth)acrylate, pentacontahectaethylene glycol (meth) acrylate, butylene di(meth)acrylate, aryl (meth) acrylate, trimethylol propane (meth)acrylate, hexanediol di(meth)acrylate, tripropylene glycol di(meth) acrylate, pentaerythritol tetra(meth)acrylate, pentaerythritol hexa(meth)acrylate, 1,6-hexanediol di(meth)acrylate, neopentyl glycol penta(meth) acrylate, and phosphagen hexa(meth)acrylate.

The above compounds may also be used as an oligomer. It is also possible to use acrylic reactive polymers constituted by polymers of the above substances or their derivative, such as polyester acrylates, and epoxy acrylates. These monomers, oligomers, and acrylic reactive polymers may be used alone or as a mixture of two or more.

As described above, a thermoplastic copolymer resin with a reactive ultraviolet absorber chemically immobilized thereon may be prepared by copolymerizing a monomer or an oligomer of the thermoplastic resin or the acrylic reactive polymer with a reactive ultraviolet absorber. The content of the reactive ultraviolet absorber in the copolymer resin is preferably in the range of from 10 to 90% by weight, particularly preferably in the range of from 30 to 70% by weight. When the content is less than 10% by weight, it is difficult to provide satisfactory light fastness. On the other hand, when it exceeds 90% by weight, problems occur such as sticking at the time of coating and bleeding of the image at the time of the transfer onto the dye image. The molecular weight of the copolymer resin is preferably in the range of form about 5,000 to 290,000, particularly preferably about 9,000 to 250,000. When the molecular weight is less than 5,000, the coating strength is so low that toughness required of the protective layer cannot be ensured. On the other hand, when it exceeds 300,000, the viscosity is increased, rendering the handling troublesome. The ultraviolet barrier layer according to the present invention may be formed of a resin with the above reactive ultraviolet absorber chemically bonded thereto. This layer may be formed of the above resin alone, or alternatively a mixture of the above resin with other resin(s). One example of the structural formula of the thermoplastic copolymer resin copolymerized with the reactive ultraviolet absorber is represented by the following formula. However, the copolymer resin is not limited to those represented by the following formula.

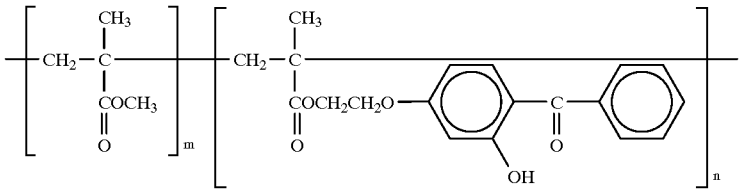

In the formation of the ultraviolet barrier layer on the transparent sheet, if the adhesion between the barrier layer and the transparent sheet are poor, a primer layer may be formed. The primer layer may be formed of a urethane resin, a polyester resin, a polypropylene resin, a polyol resin, or a reaction product of the above resin with an isocyanate compound. Isocyanate compounds usable herein include conventional isocyanate compounds such as diisocyanate compounds and triisocyanate compounds. Preferably, the primer layer has a thickness of 0.1 to 10 $\mu$m.

In general, as shown in FIGS. 3 and 4, the ultraviolet barrier layer is preferably provided as a layer 5 between the water-absorptive surface layer 4 and the heat-sensitive adhesive resin layer 6. The ultraviolet barrier layer 5 may be formed by the same method as used in the formation of the water-absorptive protective layer, and a thickness of about 0.1 to 5 $\mu$m suffices for the ultraviolet barrier layer.

Heat-Sensitive Resin Layer

In order to satisfactorily transfer the above layers in good adhesion onto the printed face, a heat-sensitive adhesive resin layer 6 may be provided as the outermost layer. The heat-sensitive adhesive resin layer 6 may be formed of a resin having good adhesion in a hot state, for example, an acrylic resin, a vinyl chloride resin, a vinyl acetate resin, a vinyl chloride/vinyl acetate copolymer resin, a styrene/acrylic copolymer resin, a polyester resin, or a polyamide resin. The heat-sensitive adhesive may be formed by bringing at least one member selected from the above resins to a coatable form, such as a solution or an emulsion, coating the solution, emulsion or the like by a suitable method selected from the coating methods exemplified in connection with the transparent resin layer and drying the coating. The thickness of the heat-sensitive resin layer 6 is preferably in the range of from about 0.1 to 5 $\mu$m.

Backside Layer

In the thermal transfer film for a protective layer according to the present invention, a backside layer 7 (a heat-resistant slip layer) may be optionally provided on the other side of the substrate sheet remote from the thermally transferable protective layer 2, from the viewpoints of preventing sticking to a thermal head of a printer, a hot plate for transfer or the like and improving the slip properties (see FIG. 4). A conventional resin, such as a resin prepared by curing a butyral resin or the like cured with an isocyanate compound or a silicone resin, as such may be used for constituting the backside layer 7. A thickness of about 0.1 to 5 $\mu$m suffices for the backside layer 7. Further, if necessary, the backside layer may be provided through a primer layer.

Method for Producing and Transferring Thermal Transfer Film for Protective Layer Each layer constituting the thermal transfer film for a protective layer according to the present invention has been described. The whole thickness of the thermally transferable protective layer is preferably in the range of from about 0.5 to 200 $\mu$m. This thermally transferable protective layer may be provided alone to form a transfer film for a protective layer only. Alternatively, for example, thermal transfer ink layers, such as thermally sublimable dye ink layers of yellow, magenta, and cyan or a hot-melt type transfer ink layer (containing carbon black) of black, may be arranged in face serial manner on an identical substrate to form an integral transfer film comprising thermal transfer ink layers and a thermally transferable protective layer arranged in face serial manner on an identical substrate. In the case of the integral thermal transfer film, the plate pattern is not particularly limited. For example, a transfer film with the following layer patterns being provided in a face serial manner may be mentioned (In the following description, for colors, yellow is referred to as "Ye", magenta as "Mg", cyan "Cy", and black "Bk"):

(1) Ye dye layer, Mg dye layer, Cy dye layer, and thermally transferable protective layer, (2) Ye dye layer, Mg dye layer, Cy dye layer, Bk dye layer, and thermally transferable protective layer, (3) Ye dye layer, Mg dye layer, Cy dye layer, Bk melt ink layer, and thermally transferable protective layer, (4) Bk dye layer and thermally transferable protective layer, and (5) Bk melt ink layer and thermally transferable protective layer.

In these plate patterns, the size of the Bk dye layer, the Bk hot-melt ink layer, and the thermally transferable protective layer may be larger than the other layers. A detection mark for detecting each layer may be provided anywhere in each layer. For example, it may be provided at the head of each layer area or at the head in the color in the front position. In the integral transfer film comprising ink layers and a thermally transferable protective layer arranged in a face serial manner on an identical substrate, registration in these predetermined patterns followed by overprinting is necessary. In this case, an additive, such as a fluorescent brightener, may be incorporated into each layer to permit the registration to be easily performed visually or in a mechanical detection manner upon ultraviolet irradiation or the like. Regarding the thermal transfer ink layers, inks and methods for the conventional thermal transfer sheet as such may be used for the material of the ink, the method for providing the ink on the substrate and the like.

Images to be protected by using the thermal transfer film for a protective layer are usually those formed by the thermal sublimation type transfer method and/or the hot-melt type transfer method. In particular, when the thermal transfer film for a protective layer is applied to an image formed by the thermal sublimation type transfer, a protective layer is formed on the image and, at the same time, the dye constituting the image is again subjected to color development by heat applied at the time of transfer, offering the effect of rendering the image more clear. Utilization of the thermal transfer film for a protective layer according to the present invention is not limited to this only, and the thermal transfer film for a protective layer may be utilized in a wide variety of other applications.

The thermal sublimation type transfer image and/or the hot-melt type thermal transfer image is formed by using a thermal transfer sheet having a thermal sublimable ink layer, a thermal transfer sheet having a hot-melt ink layer, or the thermal transfer sheet for a protective layer according to the present invention onto an image-receiving sheet or a card substrate comprising a plastic sheet substrate of a polyester resin, a vinyl chloride resin, a vinyl chloride/vinyl acetate copolymer resin, or a polycarbonate, a thermal transfer image-receiving sheet comprising a dye-receptive resin layer (a receptive layer) on a substrate sheet described below, or a film, a sheet, or a molded product of the above resin to constitute the print of the present invention. Dye-receptive resins usable herein include polyolefin resins, such as polypropylene; halogenated resins, such as polyvinyl chloride and polyvinylidene chloride; vinyl resins, such as polyvinyl acetate and various polyacrylates; polyester resins, such as polyethylene terephthalate and polybutylene terephthalate; polystyrene resins, such as polystyrene and copolymers thereof; polyamide resins; resins of copolymers of olefins, such as ethylene or propylene with other vinyl monomers; ionomers; cellulosic resins, such as cellulose diacetate, and cellulose triacetate; and polycarbonates. A release agent, such as a silicone oil, may be incorporated into the resin in order to prevent from the resin fusing to the thermal transfer film for a protective layer or the like.

Sheet substrates usable in the thermal transfer image-receiving sheet include (1) synthetic papers (polyolefin, polystyrene or other types of synthetic papers), (2) wood free paper, art paper, coat paper, cast coated paper, wall paper, backing paper, paper impregnated with a synthetic resin solution or an emulsion, paper impregnated with a synthetic rubber latex, paper with a synthetic resin being internally added thereto, paperboard, and natural fiber papers such as cellulose fiber papers, and (3) films or sheets of various plastics, such as polyolefin, polyvinyl chloride, polyethylene terephthalate, polystyrene, polymethyl methacrylate, and polycarbonate. Among the above substrates, the synthetic papers (1) preferably have a micro-void layer having low thermal conductivity (namely, high insulating properties) on the surface thereof. Further, laminates of any combination of the sheets (1) to (3) are also usable. Representative examples of laminates usable herein include a laminate of a cellulose fiber paper with a synthetic paper or a laminate of a cellulose paper with a plastic film or sheet.

A material for a card as an object, on which an image is to be formed, will be described. The card substrate used in the present invention comprises a resin dyeable with a thermally sublimable dye. Conventional substrates including films or sheets of various plastics, such as polyolefins, polyvinyl chloride, polyethylene terephthalate, polystyrene, polymethacrylate, and polycarbonates; white opaque films or sheets formed from a synthetic resin with a white pigment or a filler added thereto, or a foamed sheet; and synthetic papers (polyolefin, polystyrene or other types of synthetic papers) as such may be used. If necessary, a dye-receptive layer may be formed thereon. Further, wood free paper, art paper, coat paper, cast coated paper, wall paper, backing paper, paper impregnated with a synthetic resin solution or emulsion, paper impregnated with a synthetic rubber latex, paper with a synthetic resin being internally added thereto, paperboard, and cellulose fiber paper, each having thereon a dye-receptive layer, may also be used. That is, the card substrate used in the present invention is not particularly limited. Furthermore, laminates of any combination of the above substrate films may also be used.

One example of preferred card substrates according to the present invention has such a construction that a transparent polyvinyl chloride layer is laminated on both sides of a polyvinyl chloride sheet containing a white pigment with a suitable amount of a plasticizer incorporated into at least the transparent vinyl chloride layer as an image forming face to improve the dyeability of the layer with the dye. The amount of the plasticizer is preferably in the range of form 0.1 to 10 parts by weight, particularly preferably in the range of from 3 to 5 parts by weight, based on 100 parts by weight of polyvinyl chloride for the dye-receiving face. When the amount of the plasticizer used is excessively small, the dyeability of the resin with the sublimable dye is unsatisfactory. On the other hand, when the amount of the plasticizer is excessively large, the dye-receiving face is so soft that the sheet is likely to adhere to the dye layer of the thermal transfer sheet for forming an image at the time of thermal transfer, causing the dye layer to be separated and as such transferred, that is, causing abnormal transfer. Further, in this case, a printed image bleeds during storage, unfavorably impossible to provide a sharp image. Further, a coloring pigment, a white pigment, an extender pigment, a filler, an ultraviolet absorber, an antistatic agent, a thermal stabilizer, an antioxidant, a fluorescent brightener and the like may be optionally used on the dye-receiving face of the print. Further, a desired magnetic recording layer, emboss pattern or other print pattern, an optical memory, a IC memory, a bar code and the like may be previously formed on the card substrate for a print. Further, the magnetic recording layer or the like may be provided before or after the formation of information on a photograph of a face or the like by the sublimation transfer system or the like. The photograph-like image of a face may be provided on the card substrate by the sublimation transfer system or the like using the sublimation type thermal transfer sheet according to the present invention by a conventional method. At the same time, information on letters, bar codes and the like may be formed. Preferably, the above information is formed using a hot-melt ink type thermal transfer sheet which enables high-density black printing.

A color image and/or a letter image are formed on an image-receiving sheet or a card by using a thermal transfer sheet by means of a thermal printer, and a thermally transferable protective layer is transferred using the thermal transfer film for a protective layer according to the present invention to form a protective layer. Alternatively, the thermal transfer film, for a protective layer according to the present invention, having a thermal transfer ink layer may be used. In the transfer, separate thermal printers may be used under separate conditions for the sublimation transfer, the melt transfer, and the transfer of the protective layer. Alternatively, a single printer may be used while regulating printing energy for each of transfer operation. In the thermal transfer film for a protective layer according to the present invention, heating means is not limited to the thermal printer, and other heating means, such as a hot plate, a hot stamper, a hot roll, a line heater, and an iron may also be used. The protective layer may be transferred on the whole surface of the image or on a desired area of the image.

Examples of the present invention and comparative examples will be described. In the following description, "parts" is by weight.

EXAMPLE 1

1. Preparation of Thermal Transfer Film for Sublimable Dye

Sublimable dye-containing inks of three colors comprising the following respective compositions were prepared.

| (1) Composition of yellow ink | |
|---|---|
| Quinophthalone pigment represented by the following structural formula | 5.5 parts |
| Polyvinyl butyral (S-lec BX-1, manufactured by Sekisui Chemical Co., Ltd., Japan | 4.5 parts |
| Methyl ethyl ketone/toluene (weight ratio 1:1) | 90.0 parts |

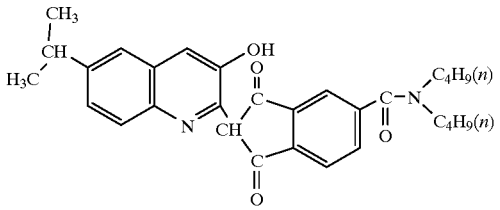

(2) Composition of Magenta Ink

A magenta ink was prepared according to the same formulation as described above in connection with the composition of yellow ink, except that a magenta dye (C.I. Disperse Red 60) was used instead of the dye used in the yellow ink.

(3) Composition of Cyan Ink

A cyan ink was prepared according to the same formulation as described above in connection with the composition of yellow ink, except that a cyan dye (C.I. Solvent Blue 63) was used instead of the dye used in the yellow ink. Separately, a 6 μm-thick axially stretched polyethylene terephthalate film (hereinafter referred to as "PET") (available from Toray Industries, Inc., Japan under the trade name "Lumirror") was provided as a substrate film. A one μm-thick heat-resistant slip layer of a silicone resin was provided as a backside layer on the whole area of one side of the substrate by gravure printing, and a 0.5 μm-thick primer layer of a urethane resin was provided on the whole area of the other side of the substrate by gravure printing. The above ink compositions, yellow, magenta, and cyan, were then subjected to solid printing in that order by gravure printing on the primer layer in a repeated and face serial manner each in a length of 15 cm at a coverage of about 3 g/m$^2$ (on a solid basis) in the direction of flow of the PET film to form an ink layer for sublimable dyes of three colors, thereby preparing a thermal sublimable dye transfer film.

2. Preparation of Thermal transfer Film for Protective Layer

A 6 μm-thick PET film (available from Toray Industries, Inc. under the trade name "Lumirror") was provided as a substrate film. A one μm-thick heat-resistant slip layer of a silicone resin was provided as a backside layer on the whole area of one side of the substrate by gravure printing. A coating liquid, for a water-absorptive surface layer, having the following composition was then coated on the other side of the substrate by gravure coating at a coverage of 10 g/m$^2$ on a dry basis, and the coating was then dried to form a water-absorptive surface layer.

Composition of Coating Liquid for Water-Absorptive Surface Layer

| | |
|---|---|
| Dispersion of colloidal silica (Snowtex OL, manufactured by Nissan Chemical Industry Ltd., Japan (average particle diameter: about 50 nm) | 100 parts |
| Polyvinyl alcohol resin (hereinafter referred to as "PVA") (Poval C318, manufactured by Kuraray Co., Ltd., Japan) | 2 parts |
| Isopropyl alcohol (hereinafter referred to as "IPA") | 20 parts |

A coating liquid, for a heat-sensitive adhesive resin layer, having the following composition was then coated on the surface of the water-absorptive surface layer by gravure coating at a coverage of 1 g/m$^2$ on a dry basis, and the coating was dried to form a heat-sensitive adhesive resin layer, thereby preparing a thermal transfer film, for a protective layer, having a water-absorptive protective layer.

Composition of Coating Liquid for Heat-Sensitive Adhesive Resin Layer

| | |
|---|---|
| Styrene/acryl emulsion (Polysol AT-2011, manufactured by Showa High Polymer Co., Ltd., Japan) | 100 parts |
| Water | 50 parts |
| IPA | 50 parts |

EXAMPLE 2

A thermal protective layer transfer film of Example 2 was prepared in the same manner as in Example 1, except that a coating liquid, for an ultraviolet barrier layer, having the following composition was coated by gravure coating at a coverage of 1 g/m$^2$ on a dry basis followed by drying to form an ultraviolet barrier layer between the water-absorptive surface layer and the heat-sensitive adhesive resin layer.

Composition of Coating Liquid for Ultraviolet Barrier Layer

| | |
|---|---|
| Emulsin of copolymer resin with reactive ultraviolet absorber chemically bonded thereto (UVA-383MG, manufactured by BASF Japan Ltd.) | 100 parts |

EXAMPLE 3

A thermal transfer film, for a protective layer, of Example 3 was prepared in the same manner as in Example 2, except that, after the formation of a water-absorptive surface layer in the same manner as in Example 2, a coating liquid for a water-absorptive fine area, having the following composition was coated on the water-absorptive surface layer by gravure coating at a coverage of 2 g/m$^2$ on a dry basis, the coating was dried to form a water-absorptive fine area, a coating liquid, for an ultraviolet barrier layer, having the following composition was further coated by gravure coating at a coverage of 1 g/m$^2$ on a dry basis and the coating was dried to form an ultraviolet barrier layer.

Composition of Coating Liquid for Water-Absorptive Fine Area

| | |
|---|---|
| Polyvinyl pyrrolidone resin (hereinafter referred to as "PVP") (PVP K-90, manufactured by ISP) | 10 parts |
| IPA | 90 parts |

Composition of coating liquid for ultraviolet barrier layer

| | |
|---|---|
| Copolymer resin with reactive ultraviolet absorber chemically bonded thereto (UVA-635L, manufactured by BASF Japan Ltd.) | 30 parts |
| Methyl ethyl ketone (hereinafter referred to as "MEK") | 70 parts |

EXAMPLE 4

A thermal transfer film, for a protective layer, of Example 4 was prepared in the same manner as in Example 3, except that a coating liquid, for a water-absorptive fine area, having the following composition was used instead of the coating liquid for a water-absorptive fine area in Example 3.

Composition of Coating Liquid for Water-Absorptive Fine Area

| | |
|---|---|
| PVP | 10 parts |
| Acrylic resin (BR-83, manufactured by Mitsubishi Rayon Co., Ltd.) | 25 parts |
| IPA | 60 parts |
| MEK | 120 parts |

EXAMPLE 5

A thermal transfer film, for a protective layer, of Example 5 was prepared in the same manner as in Example 4, except that a coating liquid, for a release layer, having the following composition was coated by gravure coating at a coverage of 0.5 g/m$^2$ on a dry basis followed by drying to form a release layer between the substrate film and the water-absorptive surface layer.

Composition of Coating Liquid for Release Layer

| | |
|---|---|
| Cellulose acetate resin (L-20, manufactured by Daicel Chemical Industries, Ltd., Japan) | 4 parts |
| Vinyl acetate (C-2, manufactured by Sekisui Chemical Co., Ltd., Japan) | 1 part |
| MEK | 95 parts |

EXAMPLE 6

A thermal transfer film, for a protective layer, of Example 6 was prepared in the same manner as in Example 5, except that a coating liquid, for a water-absorptive surface layer, having the following composition was used instead of the coating liquid for a water-absorptive surface layer in Example 5.

Composition of Coating Liquid for a Water-Absorptive Surface Layer

| | |
|---|---|
| Dispersion of colloidal silica (Snowtex OL, manufactured by Nissan Chemical Industry Ltd. (average particle diameter: about 50 nm) | 100 parts |
| PVA | 2 parts |
| Curing agent (Sumirez Resin 5004, manufactured by Sumitomo Chemical Co., Ltd., Japan) | 1 part |
| IPA | 20 parts |
| Water | 20 parts |

EXAMPLE 7

A thermal transfer film, for a protective layer, of Example 7 was prepared in the same manner as in Example 5, except that a coating liquid, for a water-absorptive surface layer, having the following composition was used instead of the coating liquid for a water-absorptive surface layer in Example 5.

Composition of Coating Liquid for a Water-Absorptive Surface Layer

| | |
|---|---|
| Dispersion of colloidal silica (Snowtex 20, manufactured by Nissan Chemical Industry Ltd. (average particle diameter: about 20 nm) | 100 parts |
| PVA | 2 parts |
| Curing agent (Sumirez Resin 5004, manufactured by Sumitomo Chemical Co., Ltd.) | 1 part |
| IPA | 20 parts |
| Water | 20 parts |

EXAMPLE 8

A thermal transfer film, for a protective layer, of Example 8 was prepared in the same manner as in Example 5, except that a coating liquid, for a water-absorptive surface layer, having the following composition was used instead of the coating liquid for a water-absorptive surface layer in Example 5.

Composition of Coating Liquid for a Water-Absorptive Surface Layer

| | |
|---|---|
| Dispersion of colloidal silica (Snowtex XL, manufactured by Nissan Chemical Industry Ltd. (average particle diameter: about 60 nm) | 50 parts |
| PVA | 2 parts |
| Curing agent (Sumirez Resin 5004, manufactured by Sumitomo Chemical Co., Ltd.) | 1 part |
| IPA | 20 parts |
| Water | 70 parts |

EXAMPLE 9

A thermal transfer film, for a protective layer, of Example 9 was prepared in the same manner as in Example 5, except that a coating liquid, for a water-absorptive surface layer, having the following composition was used instead of the coating liquid for a water-absorptive surface layer in Example 5.

Composition of Coating Liquid for a Water-Absorptive Surface Layer

| | |
|---|---|
| Dispersion of colloidal silica (Snowtex XL, manufactured by Nissan Chemical Industry Ltd.) | 100 parts |
| PVA | 2 parts |
| Curing agent (Sumirez Resin 5004, manufactured by Sumitomo Chemical Co., Ltd.) | 1 part |
| IPA | 40 parts |
| Water | 140 parts |

COMPARATIVE EXAMPLE 1

A thermal transfer film for a protective layer was formed in the same manner as in Example 1, except that a coating liquid having the following composition was used instead of the coating liquid for a water-absorptive surface layer in Example 1.

Composition of Coating Liquid for Surface Layer

| | |
|---|---|
| Acrylic resin (BR-83, manufactured by Mitsubishi Rayon Co., Ltd.) | 20 parts |
| MEK | 40 parts |
| Toluene | 40 parts |

EXAMPLE 10

The following thermal transfer image-receiving sheet and the above thermal transfer film for a sublimable dye or alternatively the above thermal transfer film for a protective layer integral with a dye layer were put on top of the other so that the receptive layer faced the dye-coated surface. Thermal energy was applied to the laminate using a thermal head of a printer linked to electric signals obtained by color separation of a photograph of a face to form a full-color image. The thermal transfer image-receiving sheet used was prepared as follows. A synthetic paper (Yupo FRG-150, thickness 150 $\mu$m, manufactured by Oji-Yuka Synthetic Paper Co., Ltd.) was used as a substrate sheet, a coating liquid, for a dye-receptive layer, having the following composition was coated at a coverage on a dry basis of 4 g/m$^2$ on one side of the substrate sheet by a bar coater, and the coating was dried to form a dye-receptive layer, thereby preparing a thermal transfer image-receiving sheet.

| (Coating liquid for dye-receptive layer) | |
|---|---|
| Vinyl chloride/vinyl acetate copolymer (Denka Vinyl 1000A, manufactured by Denki Kagaku Kogyo K.K.) | 20 parts |
| Epoxy-modified silicone oil (XL-22-2900T, manufactured by The Shin-Etsu Chemical Co., Ltd.) | 1 part |
| MEK/toluene (1/1) | 80 parts |

EXAMPLE 11

Each of the thermal transfer films for a protective layer prepared in Examples 1 to 9 and Comparative Example 1 was put on top of the full-color image formed in Example 10, and each thermally transferable protective layer was transferred onto the full-color image by means of the same printer as used in the formation of the full-color image to form a full-color image with a protective layer.

EXAMPLE 12

(Light Fastness of Transferred Image)

Sheets with a color image, prepared in Example 10, having thereon a transferred protective layer were used as samples, and the light fastness of the image face was evaluated as follows. The samples were irradiated with light from a xenon fadeometer (Ci-35A, manufactured by Atlas) at 300 kJ/m$^2$, and a change in optical density between before the light irradiation and after the light irradiation was determined using an optical densitometer (RD918, manufactured by Macbeth), and the retention of the optical density was calculated by the following equation.

Retention (%)=(optical density after irradiation)/(optical density before irradiation)

The results were evaluated according to the following criteria and are tabulated in Table 1.

○: retention of not less than 90%

Δ: retention of 80 to less than 90%

×: retention of less than 80%

EXAMPLE 13

(Stampability of Transferred Image)

The image-receiving sheets with a protective layer transferred onto a color image prepared in Example 11 were provided as samples. A stamp with an aqueous dye ink (manufactured by Shachihata Industrial Co., Ltd.) was pressed against the image face of the samples. The samples were then allowed to stand for 10 min and inspected for the fixation of the ink on the image. The results for the stamping test were evaluated according to the following criteria:

○: Ink fixed to the image

×: Ink not fixed to the image

The evaluation results are also tabulated in Table 1.

EXAMPLE 14

(Solvent Resistance and Water Resistance of Transferred Image)

The image-receiving sheets with a protective layer transferred onto a color image prepared in Example 11 were provided as samples. Swabs were impregnated respectively with acetone, ethanol, and water. The samples were rubbed with the impregnated swabs 20 times in a reciprocatory manner, and a change in state of the image and the protective layer was observed. The results for the solvent resistance and the water resistance were evaluated according to the following criteria:

○: Neither image nor protective layer damaged

Δ:Protective layer damaged although image not damaged

×: Both protective layer and image damaged

The evaluation results are also tabulated in Table 1.

EXAMPLE 15

(Plasticizer Resistance of Transferred Image)

The image-receiving sheets with a protective layer transferred onto a color image prepared in Example 11 were provided as samples. An eraser (MONO, manufactured by Tombow Pencil Co., Ltd.) was put on the image and, in this state, was allowed to stand under a load of 300 g/cm$^2$ in an environment of 60° C. for 48 hr. Thereafter, the image was inspected for damage. The results were evaluated to the following criteria:

○: Image not damaged at all

Δ: Image slightly damage

×: Image significantly damaged

The evaluation results are also tabulated in Table 1.

TABLE 1

| | Light fastness | Stampability | Solvent resistance: Acetone resistance | Solvent resistance: Ethanol resistance | Water resistance | Plasticizer resistance |
|---|---|---|---|---|---|---|
| Ex. 1 | x | ○ | x | Δ | Δ | Δ |
| Ex. 2 | ○ | ○ | x | Δ | Δ | Δ |
| Ex. 3 | ○ | ○ | ○ | Δ | Δ | ○ |
| Ex. 4 | ○ | ○ | ○ | ○ | ○ | ○ |
| Ex. 5 | ○ | ○ | ○ | ○ | ○ | ○ |
| Ex. 6 | ○ | ○ | ○ | ○ | ○ | ○ |
| Ex. 7 | ○ | ○ | ○ | ○ | ○ | ○ |
| Ex. 8 | ○ | ○ | ○ | ○ | ○ | ○ |
| Ex. 9 | ○ | ○ | ○ | ○ | ○ | ○ |
| Comp. Ex. 1 | x | x | x | ○ | ○ | x |

The present invention having the above constitution has the following effects. According to the present invention, a thermally transferable protective layer is transferred and laminated, through a thermal transfer sheet for a substantially transparent protective layer, on a print with a colorant image to form a protective layer having water absorption properties. Although a stamp of an aqueous ink could have not been successfully affixed on and, hence, has been unusable in a photograph-like image, of a face, formed of a heat-sensitive sublimable dye, a hot-melt transferable pigment-containing binder or the like in a passport or the like, the lamination of the above protective layer on the image permits the stamp of an aqueous ink to be affixed enabling a photograph-like image for a passport and the like to be prepared using the recording medium. Further, since writing of letters or the like of an aqueous ink has become possible, the present invention can be utilized in not only a photograph-like image for passports but also prints where a stamp or writing of an aqueous ink is necessary.

When the thermally transferred protective layer is partially water-absorptive and partially water-resistant according to a preferred embodiment of the present invention, solvent resistance and chemical resistance can be imparted, preventing the forgery, of passports and the like, by using solvents or chemicals.

We claim:

1. A thermal transfer film for a protective layer, comprising:

a heat-resistant substrate film; and a thermally transferable protective layer provided on the heat-resistant substrate film, the protective layer comprising (a) a substantially transparent, water-absorptive surface layer comprising dispersed particles and a resin and (b) an outermost heat-sensitive resin layer.

2. The thermal transfer film for a protective layer according to claim 1, wherein the water-absorptive surface layer constitutes, upon transfer of the thermally transferable protective layer, the outermost surface and comprises a substantially transparent porous layer.

3. The thermal transfer film for a protective layer according to claim 1, wherein the water-absorptive surface layer adapted to form the outermost surface after transfer of the thermally transferable protective layer comprises at least a partially water-absorptive layer comprising a water-absorptive area and a water-resistant area.

4. The thermal transfer film for a protective layer according to claim 3, wherein the water-absorptive area comprises a resin comprising at least both a water-soluble resin and a water-insoluble resin.

5. The thermal transfer film for a protective layer according to claim 3, wherein the substantially transparent porous layer or water-resistant area is formed of a material composed mainly of fine particles having an average particle diameter of not more than 0.1 $\mu$m.

6. The thermal transfer film for a protective layer according to claim 3, wherein the material constituting the substantially transparent porous layer or water-resistant area comprises a water-resistant resin binder.

7. The thermal transfer film for a protective layer according to claim 1, wherein the thermally transferable protective layer comprises an ultraviolet absorbing material.

8. The thermal transfer film for a protective layer according to claim 1, wherein the thermally transferable protective layer and at least one of a thermally sublimable colorant layer and a hot-melt colorant layer are provided in a face serial manner on an identical substrate film.

9. A print comprising a colorant image, the thermally transferable protective layer according to claim 1 having been thermally transferred and laminated onto at least part of an image-forming face to form a protective layer.

10. The print according to claim 9, with a stamp of an aqueous ink affixed thereon.

* * * * *